US012808391B2

(12) United States Patent
Stroeken et al.

(10) Patent No.: US 12,808,391 B2
(45) Date of Patent: Nov. 24, 2026

(54) PUMPING SYSTEM

(71) Applicant: Weir Minerals Netherlands B.V., Venki PH (NL)

(72) Inventors: Johannes Stroeken, JS Roermond (NL); Rudolfus Van Rijswick, PV Lottum (NL)

(73) Assignee: Weir Minerals Netherlands, B.V., PH Venlo (NL)

( * ) Notice: Subject to any disclaimer, the term of this patent is extended or adjusted under 35 U.S.C. 154(b) by 59 days.

(21) Appl. No.: 18/843,216

(22) PCT Filed: Mar. 6, 2023

(86) PCT No.: PCT/IB2023/052068
§ 371 (c)(1),
(2) Date: Aug. 30, 2024

(87) PCT Pub. No.: WO2023/170542
PCT Pub. Date: Sep. 14, 2023

(65) Prior Publication Data

US 2025/0180041 A1 Jun. 5, 2025

(30) Foreign Application Priority Data

Mar. 8, 2022 (GB) ..... 2203215

(51) Int. Cl.
*F04F 13/00* (2009.01)
*E21F 13/00* (2006.01)
*F04D 1/00* (2006.01)

(52) U.S. Cl.
CPC ..... *F04F 13/00* (2013.01); *E21F 13/00* (2013.01); *F04D 1/00* (2013.01)

(58) Field of Classification Search
CPC .. F04F 13/00; E21F 13/00; F04D 1/00; F04D 13/08; B65G 53/00; E21C 50/00; F04B 15/02
See application file for complete search history.

(56) References Cited

U.S. PATENT DOCUMENTS 4,391,468 A * 7/1983 Funk ..... E02F 3/94 299/8
8,678,514 B2 * 3/2014 Efthymiou ..... E02F 3/8866 299/8
10,995,773 B2 * 5/2021 Hoffman ..... B01D 21/262
(Continued)

FOREIGN PATENT DOCUMENTS

EP 3807497 A2 4/2021
GB 2575638 A * 1/2020 ..... F04B 47/04
(Continued)

*Primary Examiner* — Jesse S Bogue
(74) *Attorney, Agent, or Firm* — Morriss O'Bryant Compagni Cannon, PLLC

(57) ABSTRACT

A pumping system for pumping a medium, such as polymetallic nodules in sea water, comprises: at least one pressure exchange chamber having a valve arrangement at each end: a medium inlet at one end of the chamber operable to receive a medium; and a filling pump located at an opposite side of the chamber to the medium inlet, and being operable to draw medium from the medium inlet, through the chamber, and towards the filling pump to fill the chamber without the medium in the chamber having come into contact with the filling pump.

11 Claims, 4 Drawing Sheets

(56) References Cited

U.S. PATENT DOCUMENTS

| | | | | |
|---|---|---|---|---|
| 11,629,582 | B2 * | 4/2023 | Arribau | B01F 23/50<br>166/250.01 |
| 2019/0278306 | A1 * | 9/2019 | Shampine | F04F 13/00 |
| 2021/0246912 | A1 | 8/2021 | Hauge | |

FOREIGN PATENT DOCUMENTS

| | | | | |
|---|---|---|---|---|
| WO | WO-2010130002 | A1 * | 11/2010 | F04B 19/003 |
| WO | 2018085742 | A1 | 5/2018 | |

* cited by examiner

PUMPING SYSTEM

TECHNICAL FIELD

The present invention relates to a pumping system. In particular, although not exclusively, the present invention relates to a pumping system for use in the mining and minerals processing industry, and particularly for use in a hydraulic ore hoisting system (HOHS).

BACKGROUND

In the minerals processing industry, one problem relates to transporting ore from underground or subsea locations to a surface level. A novel system for such transportation has been described in PCT application number PCT/IB2019/055957, in the name of Weir Minerals Netherlands B.V., and is referred to as an HOHS. Other types of HOHS are also available.

One type of HOHS comprises a Positive Displacement (PD) pump, which is used to displace a mixture of ore and water, referred to as ore slurry, into a riser via a Pressure Exchange Chamber (PEC) using a driving fluid. A slurry is a two-phase mixture (a liquid with solid particles suspended or otherwise located therein). A specific advantage of the HOHS as described in PCT/IB2019/055957 is the use of a PD pump, which delivers a pressure independent flowrate and allows the use of a driving fluid containing fine particles (typically smaller than 500 μm).

A typical high-level schematic diagram of the HOHS system for use in subsea applications is shown in FIG. 1A showing both the equipment used and, to some extent, the process flow. After the ore slurry is pumped through the riser 4 to the surface, the ore slurry is dewatered (at location 5), and the carrier fluid is re-used again by the PD pump 6 as driving fluid in high pressure line 7. In FIG. 1A, Cv is the volumetric concentration of solids, and Q_up is the total volumetric flowrate of the mixture of fluid and solids delivered to the surface. Additional fluid of the same volume as the removed ore (i.e. Cv×Q_up) is added to a surface driving fluid tank to maintain balanced volumes.

One challenge in the design of the HOHS system, particularly in maritime (subsea) applications, is that the ore input to the ore slurry preparation stage 3 is in the form of soft polymetallic nodules, typically between 10 and 200 mm long. These soft nodules are easily broken, and once broken the fines that are produced are much more expensive to dewater and process than if the entire nodule was transport intact.

It is among the objects of an embodiment of the present invention to obviate or mitigate the above disadvantage or other disadvantages of the prior art or to provide a useful alternative to the prior art, or improved operation thereof.

The various aspects detailed hereinafter are independent of each other, except where stated otherwise. Any claim corresponding to one aspect should not be construed as incorporating any element or feature of the other aspects unless explicitly stated in that claim.

Reference in this specification to any prior publication (or information derived from the prior publication), or to any matter which is known, is not, and should not be taken as an acknowledgment or admission or any form of suggestion that the prior publication (or information derived from the prior publication) or known matter forms part of the common general knowledge in the field of endeavour to which this specification relates, or is even citable as prior art against this application.

SUMMARY OF DISCLOSURE

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

According to a first aspect, there is provided a pumping system for pumping a medium comprising ore suspended in carrier fluid from an underground or underwater location to a surface at a raised level, the system comprising: (i) at least one pressure exchange chamber comprising a fluid container having a valve arrangement at each end and being located at a lower altitude than the raised level; (ii) a medium inlet at one end of the chamber operable to receive a medium for transport into the chamber; and (iii) a filling pump located at an opposite side of the chamber to the medium inlet, and being operable to draw medium from the medium inlet, through the chamber, and towards the filling pump to fill the chamber without the medium in the chamber having come into contact with the filling pump.

The medium may comprise a fluid having a different property to another fluid which is driven by the medium. The different property may be temperature, salinity, solid content.

The fluid container may comprise any convenient shape and having an inlet at one end and an outlet at another end. The fluid container may comprise a pipe. The pipe may have any convenient cross-sectional shape (in some embodiments the pipe has a generally circular cross-section) and any convenient aspect ratio (length to width). In some embodiments the pipe may be elongate.

The filling pump may comprise a centrifugal pump. Alternatively, the filling pump may comprise a positive displacement pump or another type of pump.

The filling pump is preferably in direct pressure connection (or in direct pressure relation) with the pressure exchange chamber driving fluid outlet such that reducing the pressure at the filling pump results in a reduced pressure at the pressure exchange chamber driving fluid outlet. In other words, the chamber and filling pump form a closed pressure system. In such a system, there is no opening to ambient that would allow fluid at ambient pressure to be drawn in instead of the medium.

The pumping system may further comprise a harvester coupled to the medium inlet for suppling medium thereto. The harvester may create the medium comprising ore suspended in carrier fluid.

A driving fluid pump (such as a positive displacement pump, or one or more centrifugal pumps) may be provided to drive the medium from the pressure exchange chamber(s) up a discharge riser to a surface level. The discharge riser may be located at an end of the pressure exchange chamber (s) opposite the driving fluid pump. The driving fluid pump may be coupled to the pressure exchange chamber via a driving fluid riser.

The harvester may comprise a hydraulic suction device operable to lift ore in the form of nodules from the sea bed and to mix the nodules with sea water to create the medium.

The nodules may comprise particles that are typically between 10 mm and 200 mm in length. The medium may comprise settling particles in a carrier fluid which mixture is referred to as a settling slurry.

The pumping system may comprise a plurality of pressure exchange chambers, each successively filled with the medium. Each pressure exchange chamber includes a fluid container, such as a pipe that is optionally elongate or extended in any convenient configuration, such as a helix, or orientation, such as horizontal, vertical, or at any desired angle. In some embodiments, the pipe length may be selected from the range of 20 m to 400 m.

The (or each) pressure exchange chamber may include a separator between driving fluid and the medium being pumped, or the driving fluid may be in direct contact with the medium being pumped.

A first valve arrangement is preferably located at one end of the pressure exchange chamber and comprises a driving fluid entry valve, a driving fluid exit valve, a compression valve, and a decompression valve. These valves are preferably suitable for use with high dynamic pressures (e.g. greater than 40 Bar (4 MPa)) as there may be a significantly higher pressure above a valve (above the sealing point on the valve seat) than beneath the valve (below the sealing point on the valve seat).

These valves may comprise actuated valves.

A second valve arrangement is preferably located at an end of the pressure exchange chamber near to a pressurised discharge and comprises a pumped fluid (or medium) exit valve (also referred to as a discharge valve) and a pumped fluid (or medium) entry valve (also referred to as a suction valve). The pumped fluid entry and pumped fluid exit valves open in a pressure balanced situation when the pressure exchange chamber is properly decompressed or compressed respectively. These valves may comprise actuated valves or self-actuated valves.

The pumped fluid exit and entry valves are preferably suitable for use with high pressures (e.g. greater than approximately 40 Bar (4 MPa)).

The driving fluid entry valve may be opened at the same time (or approximately the same time) as the pumped fluid exit valve, during which time the driving fluid exit valve and the pumped fluid entry valve remain closed.

Similarly, the pumped fluid entry valve may be opened at the same time (or approximately the same time) as the driving fluid exit valve, during which time the pumped fluid exit valve and the driving fluid entry valve remain closed.

The underwater location may be seabed or the bed of a lake or estuary.

By locating the filling pump at the opposite end of the pressure exchange chamber to the medium inlet (or the harvester), the medium (and particularly the nodules) does not come into contact with any moving or static part in the filling pump. In embodiments where a centrifugal pump is used, the impeller is particularly destructive to ore particles in the medium. In effect, the filling pump sucks the medium from the medium inlet (and the harvester if one is connected) and into the pressure exchange chamber. The second valve arrangement may be closed before the medium comes into contact with the filling pump. If nodules were allowed to contact the impeller (or any other part of the pump) there is a significant risk of the nodules breaking down into fine particles, which are more difficult and costly to dewater at the surface.

Another advantage of locating the filling pump at the opposite end of the fluid container to the medium inlet (or the harvester) is that it is easier to control the flow rate of the medium because relatively clean water is being pumped (rather than slurry).

Another advantage of locating the filling pump at the opposite end of the fluid container to the medium inlet is that it prevents or minimises wear of the filling pump by the medium being transported.

Another advantage of the medium not coming into contact with the filling pump is that a pump can be used that does not tolerate ore particles that may be suspended in the medium.

Another advantage of the medium not coming into contact with the filling pump is that when the medium comprises ore particles suspended in water, the pump essentially pumps water so that the pump performance matches theoretical pump curve performance more closely than when pumping slurry (ore suspended in water). This makes it easier to control the pump flow velocity.

Placing the feed pump downstream of the PEC is not normally possible in a land based system. This is because in a land based system, hydraulic losses in the suction system (between the pump inlet and the source of the medium) lower the pressure throughout the suction system, including at the inlet of the pump. If the pressure at the inlet of the pump drops to, or near, the vapour pressure of the medium, then cavitation will result. The vapor pressure at room temperature is near to absolute vacuum which means that the pressure reduction in the suction system is limited to approximately 1 bar (100 kPa). When the suction losses are too high, the vapor pressure is reached locally in the suction system. Vapor bubbles are then formed which are transported in the flow. These bubbles violently collapse when the pressure is locally increased above the vapor pressure. This typically occurs in the pump. This process is called cavitation and limits operation of the pump as flow and pressure generation under cavitation conditions is limited and cavitation can be very destructive to the pump itself.

In land based pump system design, the pump is therefore located as close as possible to the medium source and the suction system is designed for minimum hydraulic losses. The objective is to have a NPSHA (Nett Positive Suction Head Available) of the suction system which is higher than the NPSHR (Nett Positive Suction Head Required) of the pump. As the atmospheric pressure at subsea is much higher than on land (1 bar per 10 m depth), risk for cavitation is minimised or practically non-existent. Understanding of this physical difference allows the feed pump to be placed anywhere along the line from slurry preparation to water outlet of the pressure exchange chamber.

Another advantage of locating the filling pump at the opposite end of the chamber to the harvester is that it is easier to control the flow rate of the medium 32. The flow rate of a centrifugal pump is dependent on both the pressure load acting on the pump as well as the density of the mixture and the presence of particles in the mixture. To control the flow rate of the feed pump its flow rate needs to be measured with a flowmeter which value can be used as the actual value in a control loop of the centrifugal pump speed. Increase of centrifugal pump speed will result in increased pressure generation by the pump which will result in increase in flow rate.

A difficulty in prior art systems is the location of the flow sensor and the disturbances of the mixture composition on the control behaviour. Ideally the flowmeter should be positioned as close to the centrifugal pump as possible, typically downstream of the pump. In the prior art systems the flowmeter needs to be able to measure the flowrate of a mixture of water and solid particles. Although such flowmeters exist, accuracy is impacted by the presence of solids and furthermore they need to be wear resistant as well. Alternatively the flowmeter can be positioned downstream of the pressure exchange chamber where it measures a relatively clean water flow. A drawback of this approach is the long distance between the pump and the flowmeter and the possible presence of flow dampening devices in-between. This makes the downstream flow measurement indirect, limiting the bandwidth of the flow measurement, limiting speed of the flow control loop. When positioning the feed pump downstream of the pressure exchange chamber, the flowmeter can measure in a relatively clean environment directly up or downstream of the feed pump. The feed pump flow is only dependent on the pressure load on the pump and not of the mixture being transported and the pump only experiences a relatively clean fluid with relatively constant density without large solid particles. In control terminology this means less disturbances which allows a more accurate control response.

According to a second aspect there is provided a method of filling a pressure exchange chamber fluid container located at a low altitude and having a medium inlet coupled to one end of the fluid container and a driving fluid outlet coupled to the other end of the fluid container, the method comprising: (i) opening a medium entry valve at the medium inlet to fill the fluid container; (ii) using an energy addition mechanism to create a lower pressure at the driving fluid inlet of the fluid container than at the medium inlet of the fluid container to draw in medium through the medium inlet without the medium in the fluid container coming into contact with the energy addition mechanism; and (iii) closing a valve to stop the intake of medium to the fluid container.

Optionally, using the energy addition mechanism comprises using a filling pump located at an opposite end of the pressure exchange chamber to the medium inlet (e.g. at the driving fluid outlet). Alternatively, using the energy addition mechanism comprises providing the medium at a higher altitude (for example, stored in a tank or reservoir) than the pressure exchange chamber fluid container such that the static head creates a higher pressure at the medium inlet of the fluid container than at the driving fluid outlet of the fluid container; such a system may include a control valve located at an opposite end of the pressure exchange chamber to the medium inlet to control the flow of the medium without the medium coming into contact with the control valve. Where higher altitude medium is provided, the energy addition mechanism may further comprise a filling pump that assists filling of the medium in the fluid container in addition to the energy added by the tank or reservoir. The combination of the tank (or reservoir), the control valve and additional filling pump provides a net addition of energy to the system, which is controllable to optimise flow rates and filling of the fluid container by the medium.

The method may include the step of opening a driving fluid outlet valve (at an opposite side of the pressure exchange chamber to the medium entry valve) after (or simultaneously with) opening the medium entry valve at the medium inlet.

The step of closing a valve to stop the intake of medium to the pressure exchange chamber may comprise closing one or both of a driving fluid outlet valve or the medium entry valve at the medium inlet. The driving fluid outlet valve may be closed first, or both valves may be closed simultaneously. Closing the driving fluid outlet valve first allows the medium entry valve to close with lower risk of medium being located on the valve seat.

According to a third aspect there is provided a method of filling a pressure exchange chamber fluid container located at a low altitude and having a medium inlet coupled to the fluid container, the method comprising: (i) opening a medium entry valve at the medium inlet to fill the pressure exchange chamber fluid container; (ii) using a pressure reducing mechanism to create a lower pressure in the pressure exchange chamber fluid container than the ambient pressure to draw in medium through the medium inlet without the medium in the fluid container coming into contact with the pressure reducing mechanism; and (iii) closing a valve to stop the intake of medium to the pressure exchange chamber fluid container.

As used herein, "ambient pressure" refers to the pressure surrounding the pressure exchange chamber at the medium inlet.

By virtue of this aspect, the method reduces the pressure in the pressure exchange chamber relative to the ambient, in contrast to the prior art which raises the pressure at the medium inlet so that medium flows from the medium inlet through the pressure exchange chamber fluid container.

Creating a pressure in the pressure exchange chamber fluid container lower than the ambient pressure may be implemented by using a filling pump located at an opposite end of the pressure exchange chamber to the medium inlet.

Closing the valve arrangement may be implemented prior to the medium reaching the filling pump to prevent the filling pump from breaking down the medium.

The low altitude may comprise a sea bed, or a sub terranean level in a mine.

Where the low altitude comprises a sub terranean level in a mine, the method may further comprise preparing the medium at a higher altitude than the pressure exchange chamber so that there is an elevated pressure at the medium inlet compared with the medium preparation location. This ensures that there is sufficient pressure difference between the medium preparation location and the medium inlet to the pressure exchange chamber to prevent cavitation and thereby allow the filling pump to be installed downstream of the pressure exchange chamber. For example, the medium preparation location may be at least 30 m (in some embodiments, at least 50 m, in other embodiments at least 100 m) above the medium inlet. The height selected may depend on the desired reduction in cavitation.

A method of operating a pressure exchange chamber fluid container may include the steps of the second or third aspects and may further comprise driving the medium out of a medium outlet port of the pressure exchange chamber and up a discharge riser to a surface level.

The pressure difference between the ambient pressure and the pressure in the pressure exchange chamber may be selected such that the medium can flow into the pressure exchange chamber fluid container without adverse cavitation effects.

According to a fourth aspect there is provided a hydraulic ore hoisting system including the pumping system of the first aspect.

It will now be appreciated that a hydraulic ore hoisting system can be provided that minimises breakage of nodules by ensuring that a filling pump does not come into contact with the nodules being transported to a surface level. If the pumping system was at ground level then the filling pump may experience excessive cavitation, but by location the filling pump at the same (or similar) elevation to the pressure exchange chamber on a sea bed, the static head of the water above the pressure exchange chamber ensures that cavitation effects are reduced.

According to a fifth aspect, there is provided a pumping system for pumping a medium, the system comprising: (i) at least one pressure exchange chamber comprising a fluid container having a valve arrangement at each end, and the fluid container having a medium inlet for receiving medium comprising ore suspended in carrier fluid for transport into the fluid container; and (ii) a filling pump located at an end of the fluid container opposite the medium inlet, and being operable to draw medium through the inlet and towards the filling pump to fill the fluid container.

According to a sixth aspect, there is provided a method of pumping a medium from a lower area to an upper area, the method comprising: (i) drawing medium into a pressure exchange chamber located at the lower area using a filling pump at a driving fluid side of the pressure exchange chamber; and (ii) closing the pressure exchange chamber prior to the medium reaching the filling pump.

BRIEF DESCRIPTION OF FIGURES

These and other aspects will be apparent from the following specific description, given by way of example only, with reference to the accompanying drawings, in which.

DETAILED DESCRIPTION

Figure 1A:
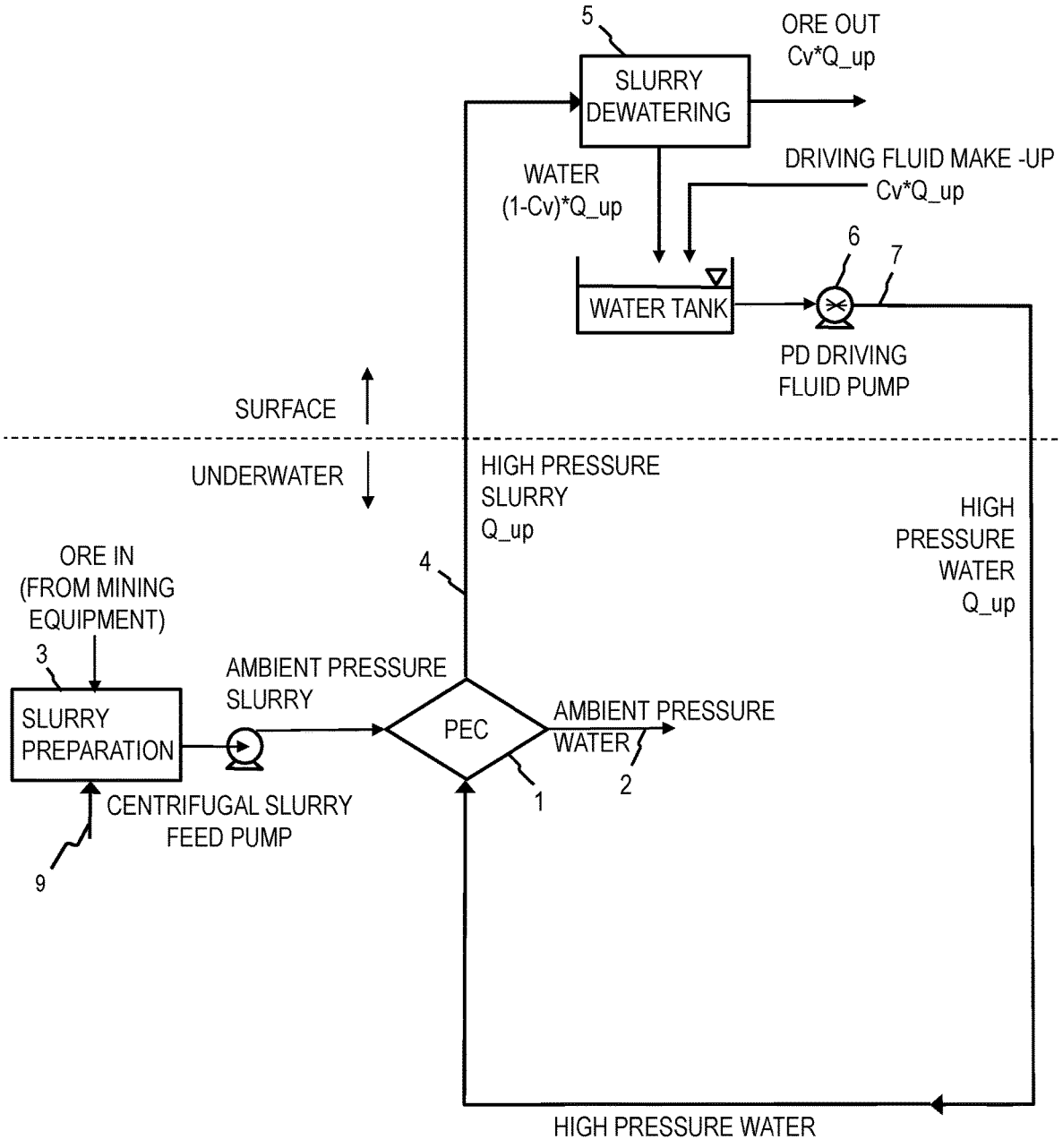
Fig. 1A (Prior Art)
FIG. 1A is a simplified schematic diagram of a prior art HOHS for maritime applications.
Figure 1B:
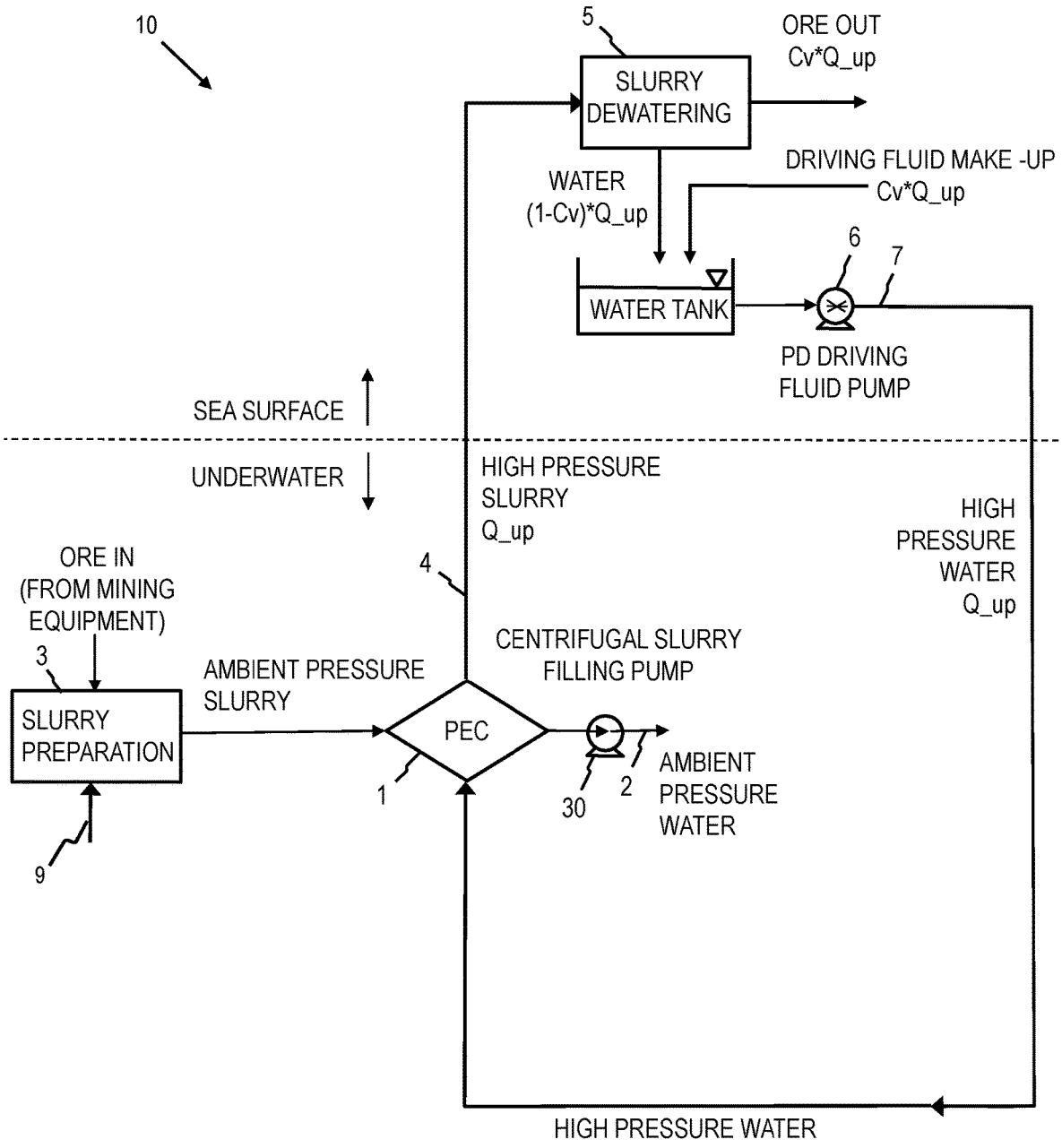
FIG. 1B is a simplified schematic diagram of an HOHS according to a first embodiment of the present invention.
Figure 2:
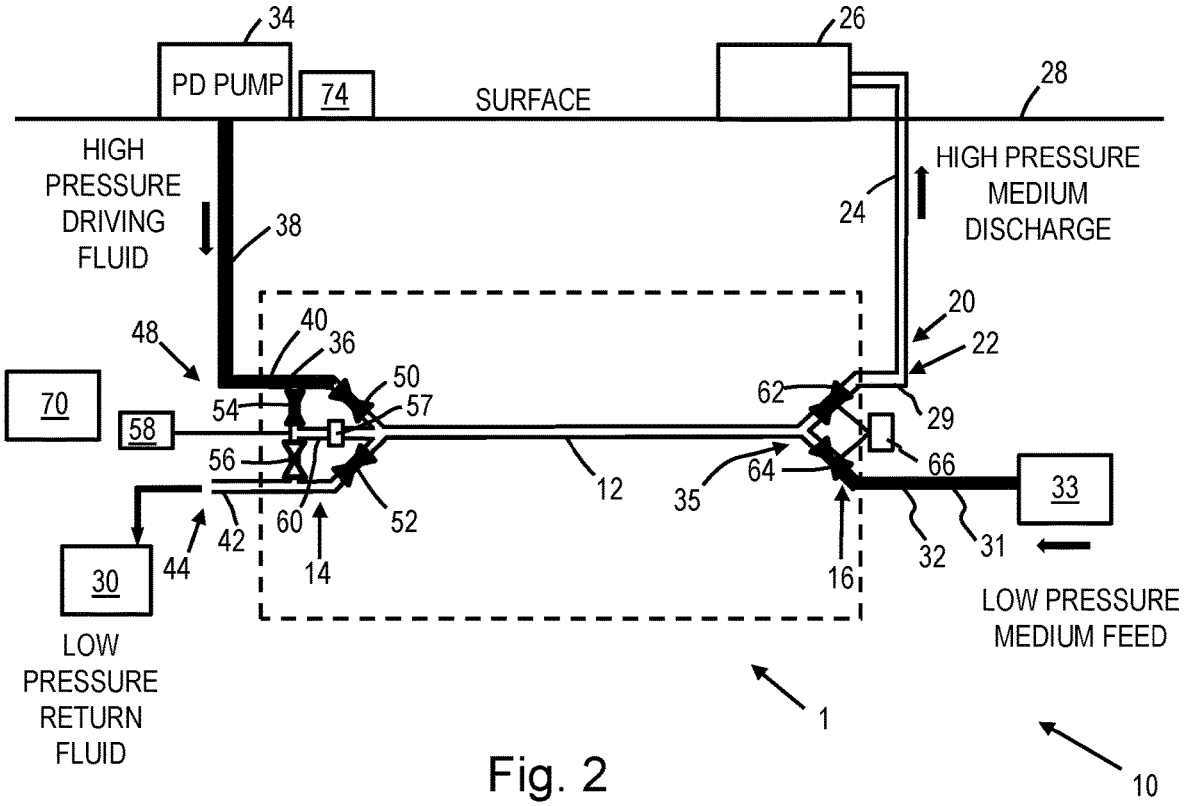
FIG. 2 is a more detailed simplified schematic diagram of the pumping system of FIG. 1B, where the first embodiment uses only a single pressure exchange chamber, and where the pressure exchange chamber is located on a sea bed beneath a surface to which medium is to be pumped.

Reference is first made to FIGS. 1B and 2, which are simplified schematic diagrams of a hydraulic ore hoisting system (HOHS) 10 according to a first embodiment of the present invention, including the pressure exchange chamber (PEC) 1. The HOHS 10 is used for underwater (in this embodiment seabed) mining activities. In FIGS. 1B and 2, similar parts use the same reference numerals as FIG. 1A to illustrate that the primary difference is in the location of the centrifugal pump 30, which is at the downstream end of the PEC 1.

In typical embodiments, all of the PEC 1 is located at a lower altitude than a final delivery point at which a medium is to be delivered by the HOHS 10. In this embodiment, the medium comprises ore particles (also referred to as nodules) ranging in size from 10 to 200 mm located in a carrier fluid (a liquid carrier) to produce a slurry of entrained and suspended ore particles.

In this embodiment, the HOHS 10 is a subsea system, the PEC 1 is located at or near the sea bed, the ore comprises polymetallic nodules, and the liquid carrier comprises sea water. Other embodiments may be land based (as described below with reference to FIG. 5) or on a bed of a freshwater lake or an estuary.

The PEC 1 comprises a single fluid container (pipe) 12, which has a valve arrangement 14, 16 at each end thereof, referred to as a driving fluid valve arrangement 14 and a pumped medium valve arrangement 16.

A pressurised discharge 20 is provided at a delivery end 22 of the PEC 1. In this embodiment, the pressurised discharge 20 is an inlet to a pumped medium riser 24 that extends in a generally vertical direction from the delivery end 22 to a collection receptacle 26 at a surface 28. A medium outlet line 29 couples the pumped medium valve arrangement 16 and the pressurised discharge 20.

The pumped medium riser 24 may be coupled to (and extend downwards from) a vessel floating on the surface 28. The vessel may comprise a ship, a barge, or the like.

A filling mechanism 30 is provided, in the form of a centrifugal pump, which is operable to fill the pipe 12 with a medium 32 to be pumped to the surface 28. The centrifugal pump 30 fills the pipe 12 with medium 32 via a medium inlet line 31. The medium inlet line 31 couples to the pipe 12 at a medium inlet 35. Significantly, the centrifugal pump 30 is located at an opposite side of the PEC 1 to a harvester 33 (in other words, the centrifugal pump 30 is downstream of the PEC 1). The harvester 33 collects ore particles (or nodules) from the sea bed, and water from a second fluid source (in this embodiment local seawater around the nodules). The mixture of the nodules and the sea water comprises the medium 32.

The HOHS 10 also includes a positive displacement pump 34, located at the surface 28 in this embodiment, which is operable to pump a driving fluid 36 through the PEC 1 and in direct contact with the medium 32 so that the medium 32 is displaced from the PEC 1 to the pressurised discharge 20 and from there to the surface 28 via the pumped medium riser 24. However, in other embodiments a different type of pump, or pump arrangement, may be used, or lifting technology that does not use any pumps.

The positive displacement pump 34 is coupled to the driving fluid valve arrangement 14 via a driving fluid riser 38 and a driving fluid inlet line 40.

A driving fluid outlet line 42 connects the PEC 1 (and particularly the pipe 12) to a driving fluid discharge point 44.

The combination of the pipe 12, the driving fluid valve arrangement 14, the pumped medium valve arrangement 16, the driving fluid inlet and outlet lines 40,42, and the medium inlet and outlet lines 31, 29 is referred to herein as an open PEC 1. "Open" refers to the direct contact between the driving fluid 36 and the medium 32. "Pressure exchange" refers to the exchange of pressure between the two different fluids being pumped (driving fluid 36 and medium 32). However, in other embodiments a spacer may be provided between the driving fluid 36 and the medium 32 so that it is an indirect pressure exchange system.

The driving fluid valve arrangement 14 is located at a positive displacement pump end 48 and comprises a driving fluid entry valve 50, a driving fluid exit valve 52, a compression valve 54, a decompression valve 56, a choke valve 57 (which may be in the form of a restriction in the pipe, i.e. a reduced diameter pipe portion), and a master valve actuator 58. The master valve actuator 58 is provided to actuate the various valves 50 to 56 at the correct time for efficient operation of the HOHS 10, as described in PCT/IB2019/055957.

Although not shown in the drawings, the driving fluid entry valve 50 is opened and closed by a hydraulic actuator. Similarly, a hydraulic actuator is paired with each of the driving fluid exit valve 52, the compression valve 54, and the decompression valve 56. Each of these hydraulic actuators is controlled by the master valve actuator 58.

In this embodiment, the master valve actuator 58 comprises a hydraulic power unit, and controls the individual hydraulic actuator in each valve 50,52,54,56, in response to the master valve actuator 58 receiving a command from a system controller 70.

In this embodiment, these valves are all high pressure (for example, greater than 40 Bar) actuated, non-return, poppet seated valves; however, in other embodiments, different types of valves may be used.

To allow the entry 50 and exit 52 valves to open in a generally pressure balanced environment, a pressure balancing line 60 having a restriction (orifice) functioning as the choke valve 57, is provided. This pressure balancing line 60 provides a bypass arrangement by coupling the compression valve 54 to the pipe 12 (bypassing the driving fluid entry valve 50), and coupling the decompression valve 56 to the pipe 12 (bypassing the driving fluid exit valve 52).

The compression valve 54 is provided to bypass the driving fluid entry valve 50 so that the pressure in the pipe 12 can be raised prior to opening of the driving fluid entry valve 50; thereby reducing the force required to open the valve 50 and reducing the fluid flow rate through the driving fluid entry valve 50 upon opening. This has the advantage of prolonging the life of the driving fluid entry valve 50.

Similarly, the decompression valve 56 is provided to bypass the driving fluid exit valve 52 so that the pressure in the pipe 12 can be lowered prior to opening of the driving fluid exit valve 52; thereby preventing high flow rates of the driving fluid 36 through the driving fluid exit valve 52 upon opening thereof.

This limits and controls the flow rate during compression and decompression of the pipe 12, thereby reducing wear in the compression 54 and decompression 56 valves.

The pumped medium valve arrangement 16 is located at delivery end 22 and comprises a pumped fluid exit valve 62 (also referred to as a discharge valve), a pumped fluid entry valve 64 (also referred to as a suction or filling valve), and a master valve actuator 66 to actuate the valves 62, 64 at the appropriate time. The pumped fluid entry 64 and exit 62 valves open in a pressure balanced situation when the PEC 1 is properly decompressed or compressed respectively.

In some embodiments the master valve actuators 58 and 66 can be combined in a single master valve actuator which controls all valve actuators of all actuated valves 50,52,54, 56,62,64.

In some embodiments, two choke valves (or restrictions) 57 may be provided, one in series with the compression valve 54 and one in series with the decompression valve 56. Other arrangements are also possible.

The HOHS 10 also includes a system controller 70 for controlling the operation of the entire system, including the pumps 30,34, the valves 50 to 56 and 62 to 64, and the master valve actuators 58,66.

The PD pump 34 needs to be provided with fluid. In this embodiment, a first (surface) fluid source 74 is provided at the surface 28 to provide water for the driving fluid 36. This provides water from the surface 28, which may be sea water in this embodiment. This provides the hydrostatic pressure benefit of using surface water. The fluid source 74 may include a filter for removing large particulates from the fluid prior to providing it to the positive displacement pump 34.

Figure 3:
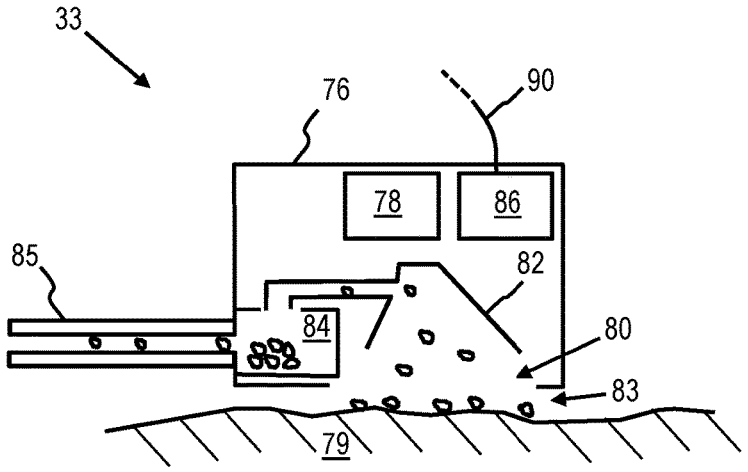
FIG. 3 is a simplified schematic diagram of part of the pumping system of FIG. 2, namely the harvester.

Reference is now also made to FIG. 3, which is a simplified schematic diagram of the harvester 33. The harvester 33 comprises a chassis 76 in which is mounted a movement system 78 (in the form of hydraulic thrusters) operable to move the harvester 33 along a sea bed 79. The chassis 76 defines an aperture 80 at a lower part thereof and aligned with a collection head 82 directed at the sea bed 79 through the aperture 80. The collection head 82 lifts nodules (illustrated (not to scale) by numeral 83) from the sea bed 79 and deposits them in a nodule hopper 84, which effectively performs the slurry preparation function 3 of FIG. 1B. A flexible suction hose 85 couples the nodule hopper 84 to the medium inlet line 31.

The nodule harvester 33 also includes a guidance system 86 that provides navigational information to the hydraulic thrusters 78 to guide it to deposits of nodules. The guidance system 86 may be connected to a transceiver on a surface ship by a wired or wireless connection (illustrated by numeral 90 in FIG. 3).

When the pumped fluid entry (suction) valve 64 is open and the filling pump 30 is operating, the filling pump 30 reduces the pressure in the pipe 12, causing the pressure to drop in the medium inlet line 31 and the flexible suction hose 85, thereby creating hydraulic suction. This, in turn, causes the mixture of nodules 83 and sea water from the nodule hopper 84 (that is, medium 32) to be sucked through the flexible suction hose 85, the medium inlet line 31 and into the pipe 12. This fills up the pipe 12 without the medium 32 coming into contact with the filling pump 30. This reduces any damage to the polymetallic nodules 83 entrained in the sea water. It also has the benefit of avoiding the requirement for a pump on the harvester 33 to feed the pipe 12 with medium 32.

The operation of the HOHS 10 is generally the same as that of prior art HOHS 1, which is described in detail in described in PCT/IB2019/055957.

Initially, there is a decompression step for the pipe 12 to the pressure in the driving fluid outlet line 42, thereby allowing the driving fluid exit valve 52 and the pumped fluid entry valve 64 to be opened. Once decompressed, the chamber 12 is filled with the medium 32, which automatically flows into the pipe 12 due to the operation of the centrifugal (filling) pump 30 reducing the pressure in the pipe 12 (the driving fluid exit valve 52 being in the open position). The filling pump 30 draws (or sucks) out the driving fluid 36 from the pipe 12 through the driving fluid exit valve 52, so that the medium 32 starts to fill the pipe 12 via the suction valve 64. The medium 32 enters the pipe 12 at a relatively high flow rate so the pipe 12 fills relatively rapidly.

Once the pipe 12 is filled, the driving fluid exit valve 52 is closed, thereby stopping the outflow of relatively low pressure driving fluid 36 from the pipe 12 and stopping the inflow of medium 32 to the pipe 12.

The nodules in the medium 32 are allowed to settle to a lower part of the PEC 1 and away from the valve seat of suction valve 64, thereby allowing a better closure of the suction valve 64.

The chamber 12 is then compressed to the pressure in the driving fluid inlet line 40 by allowing high pressure driving fluid 36, delivered by the positive displacement pump 34, to enter the pipe 12 via the compression valve 54 and the pressure balancing line 60.

The driving fluid entry valve 50 and the pumped fluid exit valve 62 are then opened so that high pressure driving fluid 36 flows into the pipe 12 displacing the pressurised medium 32 through the pumped fluid exit valve 62, the medium outlet line 29, the pressurised discharge 20, and partly up the pumped medium riser 24 (depending on the height of the riser 24).

The driving fluid entry valve 50 is then closed, stopping the inflow of driving fluid 36 into the pipe 12, and stopping the outflow of medium 32 from the pipe 12.

Although only a single pipe 12 is illustrated in the HOHS 10 of FIG. 2, in other embodiments a plurality of pressure exchange chambers may be used. For example, in FIG. 4, three PECs 201*a*, 201*b*, and 201*c* are provided in a pressure exchange system 211, and a system controller 270 manages the sequential filling and discharge of the three PECs 201*a, b,c* to provide a continuous flow of medium 32 to the surface 28.

Figure 4:
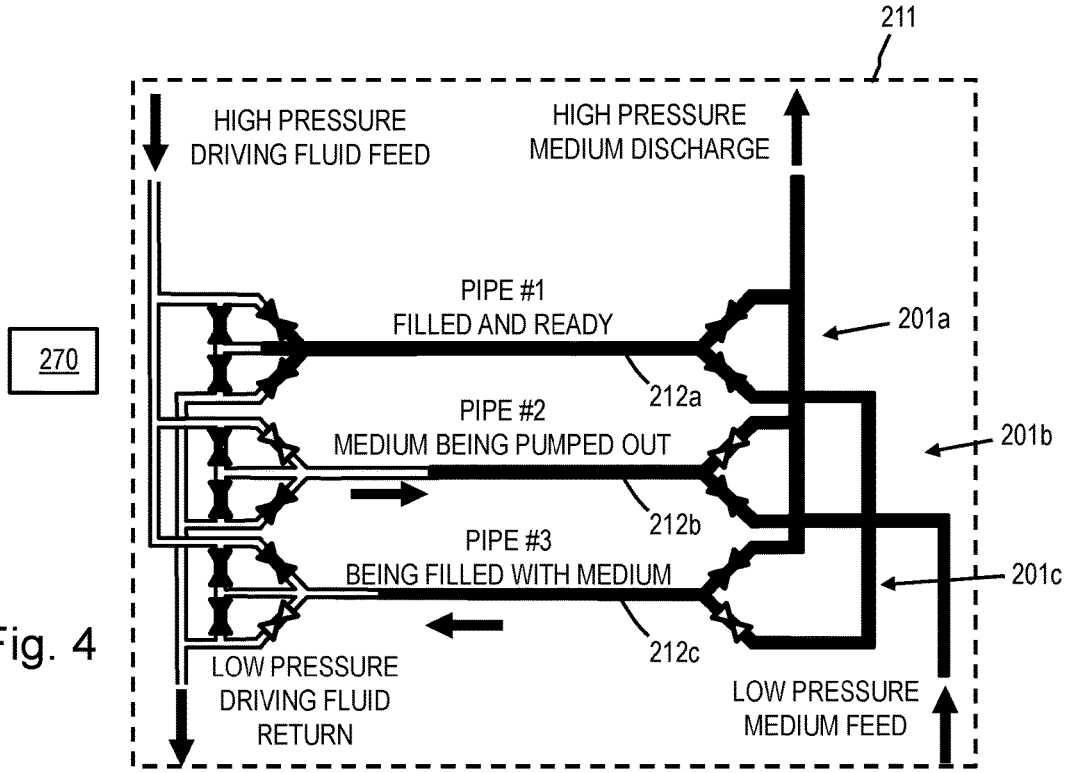
FIG. 4 is a simplified schematic diagram illustrating an alternative pressure exchange system having three pressure exchange chambers.

Each of the three PECs 201*a,b,c* includes identical valves to those described with reference to the PEC 1 of FIG. 2 (choke valve 57 is not illustrated in FIG. 4 for clarity, but it is included in each PEC 201). Each of the three pressure exchange chambers 201*a,b,c*, is identical (or at least very similar for all practical purposes) to the PEC 1.

By having multiple PECs 201 arranged in parallel, at least one PEC pipe 212*a,b,c* is always filled with medium 32 and ready for discharge, thereby allowing a continuous feed of driving fluid 36 to the PECs 201 and a continuous feed of medium 32 to the PECs 201.

Figure 5:
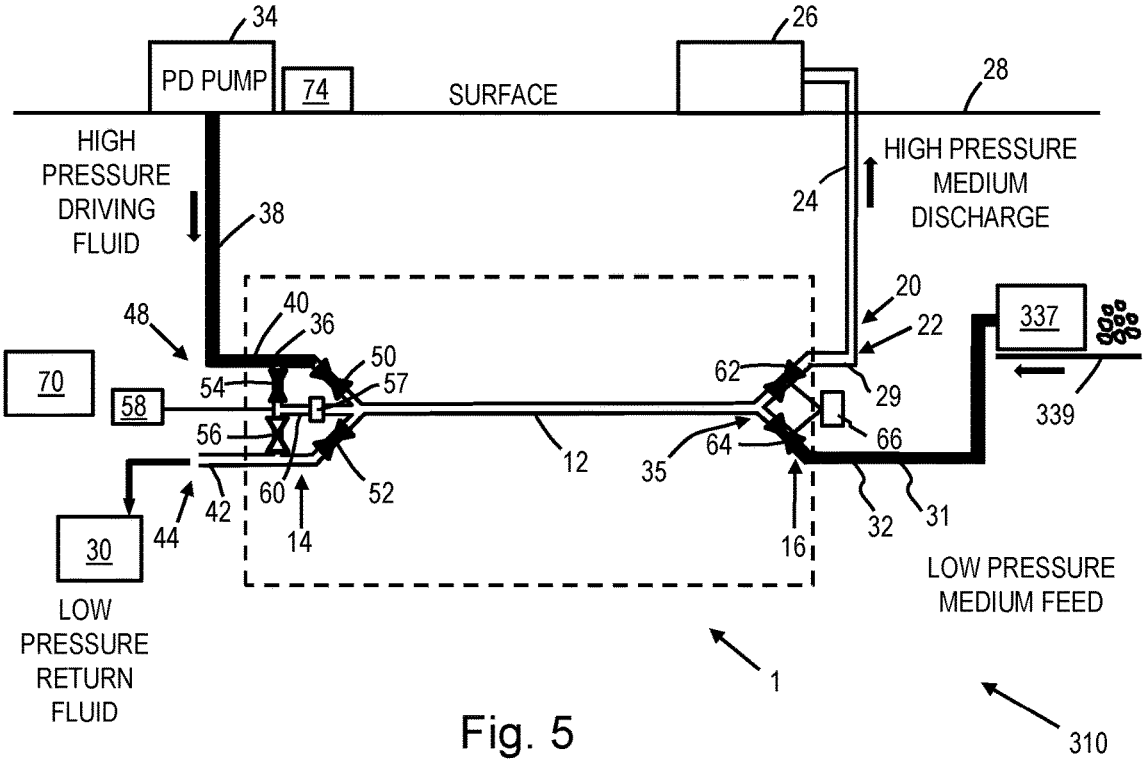
FIG. 5 is a simplified schematic diagram of another embodiment of a pumping system, where the pumping system is land based and the pressure exchange chamber is located beneath an area from which medium is to be pumped.

Reference is now made to FIG. 5, which is a simplified schematic diagram of another embodiment of an HOHS 310, where the PEC 1 (or pressure exchange system 211 could be used instead of PEC 1 if three pipes are desired) is land based and the pipe 12 (or pipes 212*a,b,c*) is located beneath an area from which medium is to be pumped. In other words, the medium preparation area is higher than the PEC 1.

The PEC 1 of FIG. 5 is identical to that of FIG. 2, and is located at a low altitude (a sub terranean level) in a mine. However, the medium is prepared by an ore mixer 337 (combining ore with water) on a raised shelf 339 that is at a higher altitude (for example at least 30 m higher) than the pipe 12 so that there is an elevated pressure at the medium inlet 35 compared with the static pressure at the ore mixer 337. This ensures that there is sufficient pressure difference to prevent cavitation and thereby allow the filling pump to be installed at the opposite end of the pressure exchange chamber. In other embodiments, the ore mixer 337 may be at least 40 m (in some embodiments, at least 50 m, in other embodiments at least 100 m) above the medium inlet 35. The height selected may depend on the desired reduction in cavitation.

Although the above embodiments have only described a direct pressure exchange chamber, the above teachings could equally be applied to an indirect pressure exchange chamber (that is, one having a separator between the driving fluid and the medium being pumped to the surface).

Similarly, although the above embodiments have only described generally horizontal pressure exchange chambers, the above teachings could equally be applied to vertical, an angled pressure exchange chambers.

Similarly, although the above embodiments have only described a positive displacement pump being used to raise the medium to the surface, other pumps could be used (such as centrifugal pumps).

In other embodiments, the filling pump may be any kind of pump (not just a centrifugal pump) because it only needs to handle a relatively clean driving fluid when it is positioned downstream of the pressure exchange chamber.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

REFERENCE NUMERALS

Pressure Exchange Chamber (PEC) 1, 201*a,b,c*
Low pressure line 2
Ore slurry preparation 3
riser 4
dewatering location 5
PD pump 6
high pressure line 7
low pressure fluid return line 9.
hydraulic ore hoisting system (HOHS) 10, 310
pipe 12, 212*a,b,c*
driving fluid valve arrangement 14
pumped medium valve arrangement 16
pressurised discharge 20
delivery end 22
pumped medium riser 24
collection receptacle 26
surface 28
medium outlet (exit) line 29
filling mechanism 30
medium inlet line 31
medium (slurry pumped) 32
nodule harvester 33
positive displacement pump 34
medium inlet 35
driving fluid 36
driving fluid riser 38
driving fluid inlet line 40
driving fluid outlet (exit) line 42
driving fluid discharge point 44
positive displacement pump end 48
driving fluid entry valve 50
driving fluid exit (outlet) valve 52
compression valve 54
decompression valve 56
choke valve 57
master valve actuator (for valves 50 to 56) 58
pressure balancing line 60
pumped fluid exit valve 62
pumped fluid entry valve 64
master valve actuator (for valves 60, 62) 66
system controller 70, 270
surface fluid source 74
harvester chassis 76
movement system (hydraulic thrusters) 78
sea bed 79
chassis aperture 80
collection head 82
nodules 83
nodule hopper 84 flexible suction hose 85
guidance system 86
guidance system to transceiver connection 90
pressure exchange system 211
system controller 270
ore mixer 337
raised shelf 339

The invention claimed is:

1. A pumping system for pumping a medium comprising ore suspended in carrier fluid from an underground or underwater location to a surface at a raised level, the system comprising:

(i) at least one pressure exchange chamber comprising a fluid container having a valve arrangement at each end and being located at a lower altitude than the raised level;

(ii) a medium inlet at one end of the chamber operable to receive a low pressure medium for transport into the chamber; and (iii) a filling pump located at an opposite side of the chamber to the medium inlet, and being operable to draw medium from the medium inlet at low pressure, through the chamber, and towards the filling pump to fill the chamber without the medium in the chamber having come into contact with the filling pump.

2. The pumping system according to claim 1, wherein the fluid container comprises an elongate pipe.

3. The pumping system according to claim 1, wherein the filling pump comprises a centrifugal pump.

4. The pumping system according to claim 1, wherein the pumping system comprises a plurality of pressure exchange chambers, each successively filled with the medium.

5. The pumping system according to claim 1, wherein a first valve arrangement is located at one end of the pressure exchange chamber and comprises a driving fluid entry valve, a driving fluid exit valve, a compression valve, and a decompression valve; and a second valve arrangement is located at an end of the pressure exchange chamber near to a pressurised discharge and comprises a medium discharge valve and a medium filling valve.

6. The pumping system according to claim 1, wherein the pressure exchange chamber is located at or near a sea bed.

7. The pumping system according to claim 1, wherein the pressure exchange chamber is located in an underground mine.

8. The pumping system according to claim 6, wherein the pressure exchange chamber is fed from a medium supply located at a higher altitude than the pressure exchange chamber.

9. An hydraulic ore hoisting system including the pumping system according to claim 1.

10. A method of filling a pressure exchange chamber fluid container located at a low altitude and having a medium inlet coupled to one end of the fluid container and a driving fluid outlet coupled to the other end of the fluid container, the method comprising:

(i) opening a medium entry valve at the medium inlet to fill the fluid container;

(ii) using a filling pump located at an opposite end of the pressure exchange chamber to the medium inlet to create a lower pressure at a driving fluid inlet of the fluid container than at the medium inlet of the fluid container to draw in medium through the medium inlet without the medium in the fluid container coming into contact with the filling pump; and (iii) closing a valve to stop the intake of medium to the fluid container.

11. The method according to claim 10, wherein closing the valve is implemented prior to the medium reaching the filling pump to prevent the filling pump from breaking down the medium.

* * * * *